US005243792A

United States Patent [19]

Vanderwal, Jr.

[11] Patent Number: 5,243,792

[45] Date of Patent: Sep. 14, 1993

[54] SCROLL FEED HONING HEAD

[75] Inventor: Frank E. Vanderwal, Jr., Frontenac, Mo.

[73] Assignee: Sunnen Products Company, St. Louis, Mo.

[21] Appl. No.: 833,770

[22] Filed: Feb. 11, 1992

[51] Int. Cl.[5] ..... B24B 33/08; B24B 33/02

[52] U.S. Cl. ..... 51/351; 51/347

[58] Field of Search ..... 51/330, 331, 347, 350, 51/351, 345

[56] References Cited

U.S. PATENT DOCUMENTS

| | | | |
|---|---|---|---|
| 1,652,885 | 12/1927 | Allyn | 51/351 |
| 1,886,584 | 11/1932 | Prange | 51/347 |
| 2,020,589 | 11/1935 | Sunnen | 51/347 |
| 2,063,931 | 12/1936 | Hutto | 51/347 |
| 2,334,838 | 11/1943 | Prange | 51/347 |
| 3,066,455 | 12/1962 | Gjertsen | 51/347 |
| 3,216,155 | 11/1965 | Sunnen | 51/347 |
| 3,378,962 | 4/1968 | Sunnen | 51/339 |
| 3,403,483 | 10/1968 | Gjertsen | 51/347 |

*Primary Examiner*—Bruce M. Kisliuk

*Assistant Examiner*—Bryan Reichenbach

*Attorney, Agent, or Firm*—Haverstock, Garrett and Roberts

[57] ABSTRACT

An improved honing head construction having one or more honing stone assemblies arranged around a rotatable mandrel body that includes a central body portion and pair of opposed end plate forming together a scroll feed up assembly operable for radially moving the honing assemblies during rotation of the mandrel for such purposes as adjusting the honing diameter, honing pressure and material removal rate, the scroll feed up assembly comprising helical scroll feed grooves located adjacent to each opposite end of the mandrel body and arranged to be positioned as mirror images of one another, each honing assembly having a pair of pin members arranged in axially aligned pairs and extending radially inwardly into radial extending bores in mandrel body, each of the Pin members having at least one tooth cooperatively engageable with one of the respective helical grooves such that all of the honing assemblies move radially in concert when the end plates are rotated relative to the central body portion.

16 Claims, 5 Drawing Sheets

SCROLL FEED HONING HEAD

BACKGROUND OF THE INVENTION

The present invention relates to an improved honing head construction and more particularly to a honing head having increased support and adjustability for the work engaging members, and which lends itself to honing with various types of abrasives including with superabrasives which are abrasives that include Particularly hard materials such as diamond particles and particles of cubic boron nitride.

PRIOR ART

Conventional honing mandrels and honing heads that use vitrified and like abrasives wear out relatively rapidly and require frequent dressing and parts replacement to maintain accuracy. Also such devices are limited as to the honing pressures they can withstand when engaging a work surface and therefore require relatively long periods of operation to hone each workpiece to a desired dimension. The known devices are not only relatively slow, but they also require considerable operator attention to adjust and replace worn parts and are not suitable for many applications. Typical of known mandrels and hone heads are those shown in Sunnen U.S. Pat. Nos. 3,216,155 and 3,378,962.

The present invention resides in a honing head capable of honing with a variety of different kinds of abrasives including with superabrasives, which head has unique means for supporting and adjusting the abrasive assemblies including during honing and for maintaining substantial force on the abrasive assemblies against the work during honing, which unique means include scroll type feed up means which are adjustable during honing to radially advance and radially retract the work engaging assemblies. The present construction can be accurately and precisely controlled, it provides a very substantial range of diametral adjustability, is relatively easy to maintain and to remove and replace parts on, it is smooth operating and chatterfree, it can be used to hone in blind as well as open ended holes, it is adaptable for use with superabrasives and it uses a unique form of support means including pin support means for supporting the work engaging assemblies adjacent the ends thereof and by means that include scroll feed up members that engage and support the pin support members. The present construction also prevents axial looseness between the work engaging members and the feed up means or scrolls and prevents such looseness from affecting the accuracy of the device and the support provided to the work engaging assemblies.

The closest known prior art devices to the present device are the devices disclosed in Pranges U.S. Pat. Nos. 1,886,584 and 2,334,838. These patents show scroll type feed devices which are not adjustable during honing other than possibly by hand and in the Prange devices support for the work engaging assemblies is provided directly by engagement between spaced opposed scroll members and the honing assemblies themselves. Any axial looseness or clearance between the engaged teeth of the scrolls and the teeth on the honing assemblies in the Prange devices will adversely affect the accuracy of such constructions and would be unsuitable for maintaining accurate support for the honing assemblies including ones that use superabrasives. Also the Prange constructions make no provision for radially advancing as well as radially retracting the work engaging members during a honing operation, and with the Prange devices the engaged teeth not only provide the honing pressure but they also absorb and transfer the stroking forces to the mandrel and this in itself will produce axial looseness between the members and accompanying honing inaccuracies. This is because the engaged teeth, including the scroll teeth and the teeth engaged therewith on the honing assemblies at both opposite ends of the Prange devices must alternately be loaded in an axial direction to reverse the direction of axial movement of the mandrels during stroking.

The present construction overcomes the shortcomings and limitations of the prior art and teaches the construction of a novel scroll feed honing head or mandrel, adaptable for use with conventional abrasives as well as with superabrasives, which device transfers forces from the body of the head to the work engaging members through special pins that are movable in radial or substantially radial bores in the body of the head. Furthermore, with the present device, the axial forces that produce the stroking are not transferred through the scroll feed members between the body and the work engaging assemblies. The present construction therefore provides a more rigid construction and one that is able to be more accurately controlled and adjusted including during honing operations than known constructions.

OBJECTS OF THE INVENTION

A primary object of the present invention is to provide a honing head with improved means for adjusting and supporting the work engaging members during operation, which head can be used to hone with superabrasives.

Another object is to enable a relatively wide range of radial adjustment of the work engaging members on a honing head.

Another object is to provide an in-process adjustable honing head which requires relatively little maintenance and parts replacement.

Another object is to reduce the time required to hone surfaces.

Another object is to provide a honing head with radially movable work engaging members which can be advanced and retracted radially including during honing operations.

Another object is to increase the accuracy and adjustability of a honing head.

Another object is to support the radially movable work engaging elements on a honing head by radially movable support means.

Another object is to make the adjustment of radially movable work engaging members on a honing head independent of the forces that cause the head to be reciprocated during operation.

These and other objects and advantages of the present invention will become apparent after considering the following detailed specification of preferred embodiments in conjunction with the accompanying drawings.

DETAILED DESCRIPTION OF PREFERRED EMBODIMENTS

Figure 1:
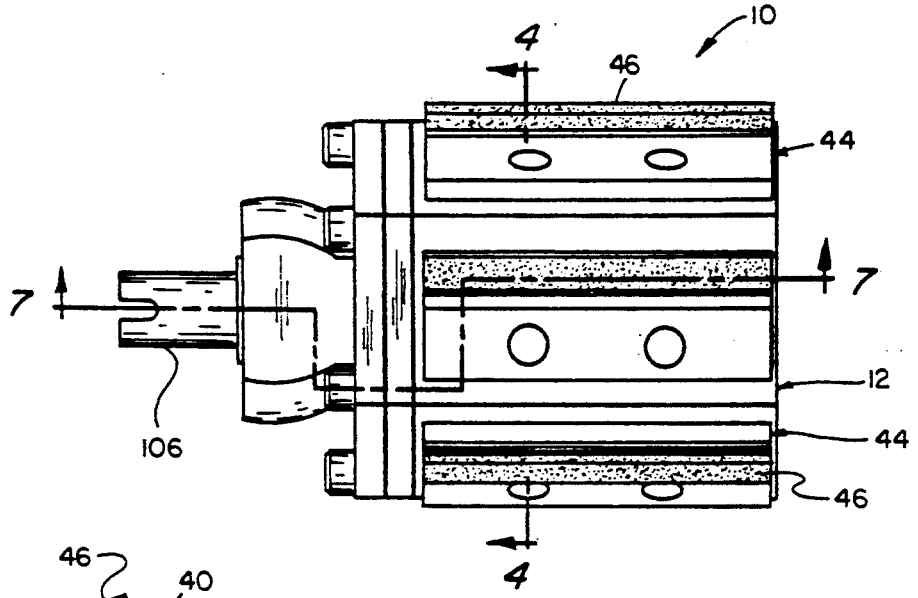
FIG. 1 is a side-elevational view of a honing head constructed according to the teachings of the present invention.

Referring to the drawings which show preferred embodiments of the subject construction, FIG. 1 shows a honing head 10 incorporating the teachings of the present invention. The honing head 10 includes a multiple sided body portion 12 which is best described in reference to FIGS. 2-5. The multi-sided body portion 12 has a central axial bore 14 extending therethrough between counterbores 16 and 18 located at opposite ends of the body 12. The body 12 has a plurality of bores 20 and 22 extending radially or nearly radially inwardly from each of the multiple sides thereof adjacent to the opposite ends thereof respectively which radial bores 20 and 22 communicate with the respective counterbores 16 and 18. Each of the radially extending bores 20 is open along a portion of a side thereof in communication with the counterbore 16 and each of the bores 22 are open along a portion of a side thereof in communication with the counterbore 18. A plurality of other bores 24 and 26 extend from each of the multiple sides of the body 12 in parallel relation to the radial bores 20 and 22. The counterbore 16 on one end of the body 12 receives a drive scroll feed member 28 and the opposite counterbore 18 receives a similar opposing follower scroll feed member 30. The scroll feed members 28 and 30 are fixedly mounted on a shaft 32 which extends through the axial body bore 14 and through the counterbores 16 and 18. The construction of the scroll feed members 28 and 30 and the means for mounting them on the shaft 32 are described in detail below.

Figure 3:
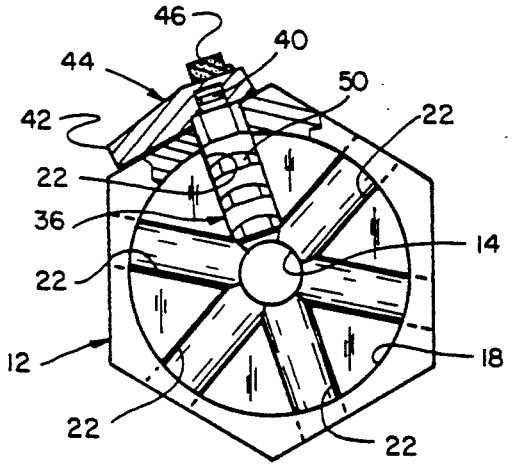
FIG. 3 is a right end view in partial cross-section of the honing head construction of FIG. 1.
Figure 4:
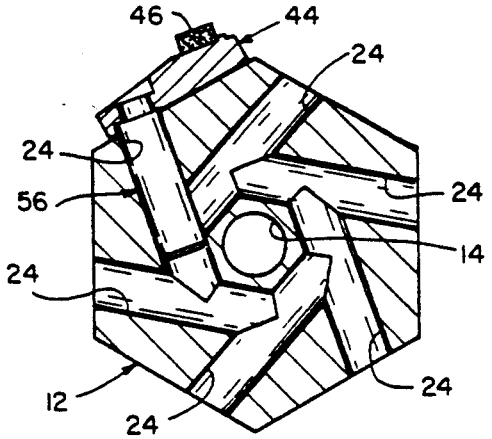
FIG. 4 is a partial cross-sectional view taken on line 4-4 of FIG. 1.
Figure 7:
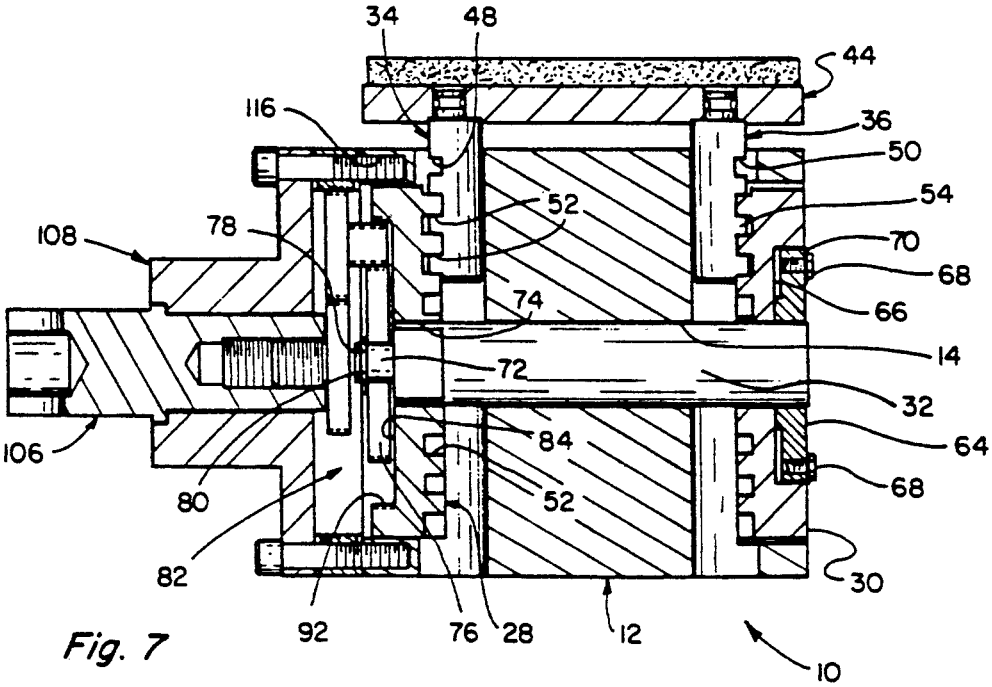
FIG. 7 is a cross-sectional view of the subject honing head taken along line 7—7 of FIG. 1.

The bores 20 and 22 extending radially inwardly from each respective side of the body 12 receive respective pairs of rack pin members such as rack pin members 34 and 36 associated with the aligned radial bores 20 and 22 on each side of the body 12. The rack pin members such as 34 and 36 each have end portions 38 and 40 that include means for attachment at spaced locations to a support portion 42 of a honing or stone assembly 44, the honing head 10 shown having provision for six honing assemblies 44. The honing assemblies 44 are mounted at angularly spaced locations around the body 12, and each includes a honing stone or abrasive member 46 which is that portion of the assembly 44 that engages the surface of the work or bore to be honed and removes material or stock therefrom during honing. Importantly, the rack pins such as pins 34 and 36 each have a plurality of respective sidewardly extending teeth 48 and 50 which are oriented to extend or face endwardly from the open sides of the bores 20 and 22 and into the counterbores 16 and 18, as shown in FIGS. 3 and 7. The teeth 48 and 50 further are cooperatively receivable in helical grooves 52 and 54 respectively located on opposing faces of the scroll feed up members 28 and 30, the groove 52 of scroll feed member 28 being shown in FIG. 9. The teeth 48 and 50 are engageable with laps or surfaces of the scroll feed up members 28 and 30 that define the grooves 52 and 54 for supporting and determining the radial outwardly extended positions of the honing assemblies 44, the radial position of the teeth of each pair of rack pins relative to the central axis of the scroll members being different than those of the other pairs, as discussed below.

Each of the honing assemblies 44 has a pair of other attached guide pin members 56 and 58 positioned for movement in and along respective ones of the bores 24 and 26 in the body 12. The guide pins 56 and 58 of each honing assembly 44 are oriented parallel to the rack pins thereof such as pins 34 and 36 and provide guidance for the radial outward and inward movements of the honing assembly 44 relative to the body portion 12. Importantly, the guide pins 56 and 58 act only to guide and prevent movement of the honing assembly 44 axially or laterally relative to the body portion 12, but do not affect the radially extended position of the honing assembly 44, the radially extended position thereof being determined solely by the cooperative engagement of the teeth 48 and 50 with the helical grooves 52 and 54.

Figure 2:
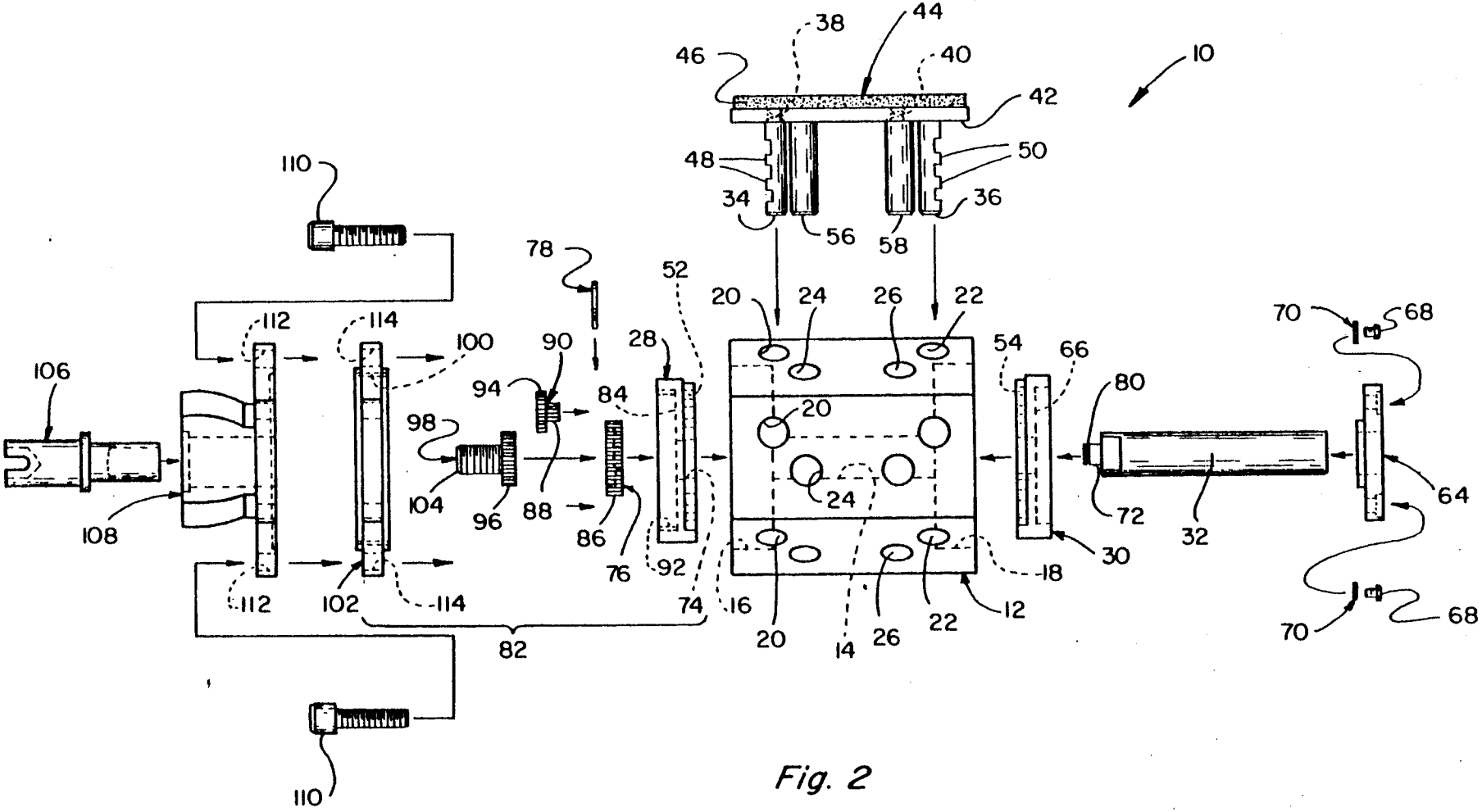
FIG. 2 is an exploded view of the honing head construction of FIG. 1 showing one of the honing assemblies thereof.
Figure 6:
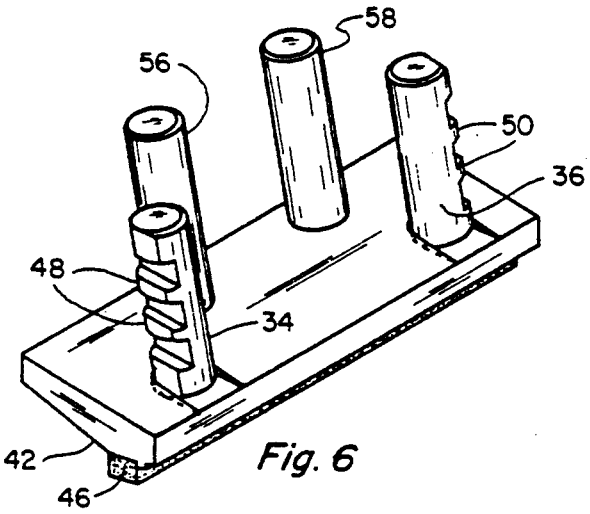
FIG. 6 is a perspective view of one of the honing assemblies used on the honing head of FIG. 1.

Referring to FIGS. 2 and 7, the shaft 32 has an end plate 64 fixedly attached to one of its ends which plate cooperates with a circular cutout 66 formed in the end face of the follower scroll feed member 30. The plate 64 can be attached to the scroll feed member 30 using any suitable means such as by a plurality of clamp screws 68 and washers 70 or like means. This means of attaching the plate 64 to the scroll member 30 provides means for precision aligning of the helical scrolls on the scroll feed members 28 and 30 so that they are mirror images of one another. The shaft 32 extends through the central bore 14 of the body 12 and a portion of the opposite end of the shaft 32 from the plate 64 extends through and is connected to the scroll plate 28 such that the scroll plates 28 and 30 will rotate together. The opposite end portion of the shaft 32 also includes a stub shaft portion 72 which extends from bore 74 in the scroll member 28, the stub shaft 72 receiving an idler gear member 76 which is freely rotatable relative thereto and maintained thereon by a snap ring 78 which cooperatively engages a groove 80 adjacent to the free end of the stub shaft portion 72. The idler gear 76 is part of a planetary gear assembly 82 and is positioned in a circular cutout 84 formed in the drive scroll member 28. The idler gear 76 has teeth 86 around its periphery which mesh with teeth 88 on one side of a plurality of similar planetary gear members such as gear member 90, and the teeth 88 mesh on their other side with internal gear teeth 92 on the drive scroll member 28. The plurality of planetary gear members 90 have other connected gear portions with teeth 94 which mesh on one side thereof with teeth 96 on a drive or sun gear member 98 located at the center of the planetary gear assembly, and on their opposite side with gear teeth 100 that extend around the inside periphery of annular gear member 102. The sun gear 98 has a threaded shaft portion 104 which threadedly engages the end portion of a feed adapter member 106 which is driven by feed up means located in the honing machine.

Figure 5:
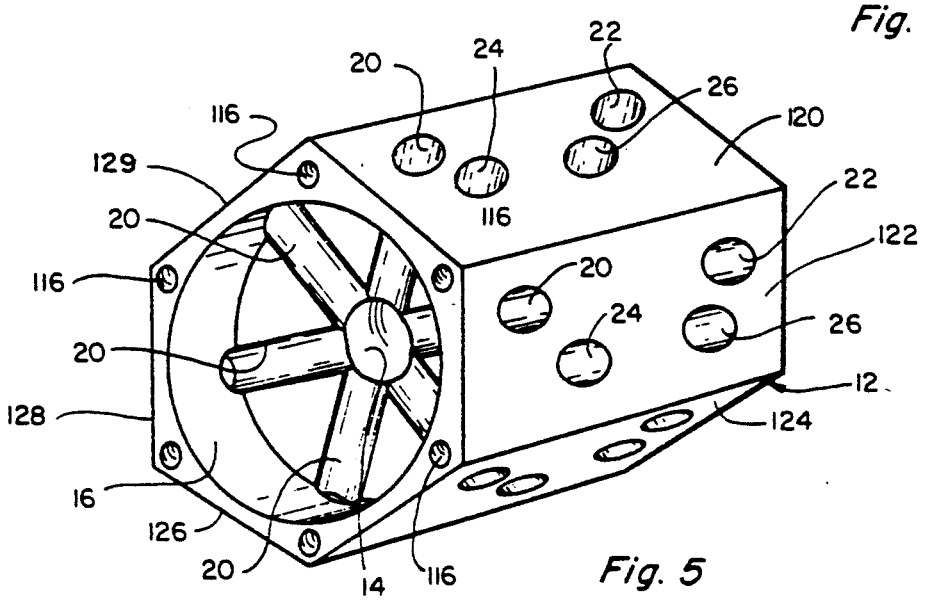
FIG. 5 is a perspective view of the body portion of the honing head of FIG. 1.

The feed adapter 106 connects with means on a honing machine for adjusting the honing diameter of the honing head 10. The feed adapter 106 rotatably extends through a tool holder 108 which is mountable on the drive means (not shown) provided for rotating the honing head 10. These drive means may be in-line drive means such as the rotatable spindle of a honing machine or they may include means having one or more intermediately located universal connections. The tool holder 108 and the annular gear member 102 are attached to an end portion of the honing head body 12 by a plurality of threaded members 110 which pass through aligned bores 112 and 114 in the tool holder 108 and in the gear 102, respectively, and threadably engage respective ones of a plurality of threaded bores 116 in the mandrel body 12 as shown in FIGS. 5 and 7. Importantly, the feed adapter member 106 can be rotated independently of the tool holder 108 so as to enable adjusting the honing diameter of the honing head 10 while it is being rotated. Rotation of the feed adapter 106 in one direction acts to rotate the planetary gear assembly 82 such that the scroll feed members 28 and 30 and the connecting shaft 32 are rotated so as to extend the rack pins and associated honing assemblies 44 radially outwardly for expanding the honing diameter of the honing head 10. Rotating the feed adapter 106 in the opposite direction rotates the planetary gear assembly 82 and scroll feed members 28 and 30 oppositely to retract the rack pins and the abrasive honing assemblies 44 attached thereto radially inwardly to decrease the honing diameter.

Figure 9:
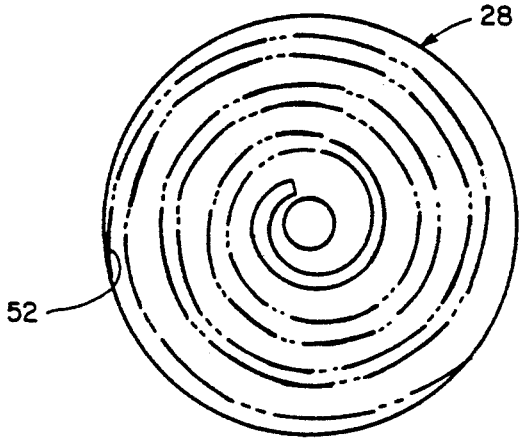
FIG. 9 is a side-elevational view of one of the scroll members employed on the subject honing head.
Figure 8:
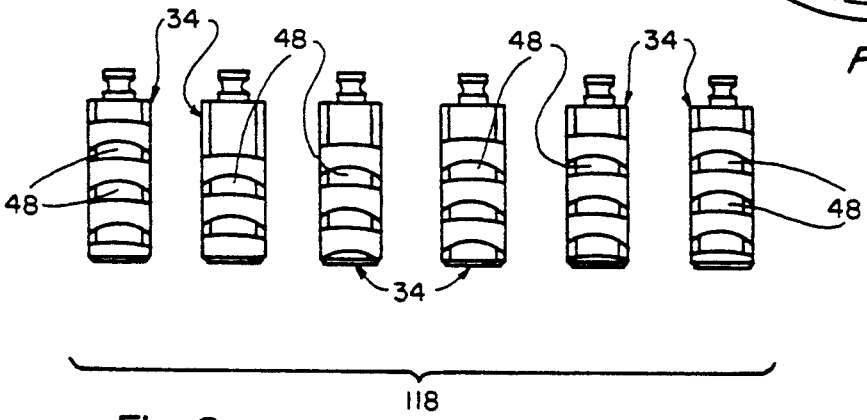
FIG. 8 shows a set of six pin members for engaging a scroll feed member at one end of the subject honing head.

The present honing head 10 can have any number of honing or stone assemblies such as assemblies 44, or shoe assemblies, a typical honing head configuration having two or more such assemblies. Each honing assembly is connected to a pair of rack pins 34 and 36 having one or more teeth 48 and 50, respectively which cooperatively engage the respective grooves 52 and 54 in the scroll feed members 28 and 30 for supporting and radially moving the honing assemblies as discussed above. The teeth 48 and 50 of the pair of rack pins for a particular honing assembly 44 are located at the same radial orientation and extension relative to the axis of the scroll members 28 and 30 such that all of the honing assemblies 44 are at the same radial extended position along their lengths for a particular rotational position of the scroll members. The radial positions of the teeth 48 and 50 for each honing assembly 44 of a honing head are therefore different depending on the angular location of a respective honing assemblies around the axis of the scrolls. The positions of the teeth 48 for the pins of a full set of rack pins 118 comprising the six rack pins 34 of the six honing assemblies 44 of the head 10 are shown in FIG. 8. The positions of the teeth 50 on the corresponding set of rack pins 36 will be the same as that shown for the pins 48. The teeth position arrangement shown in FIG. 8 enables all of the teeth 48 (or 50) at each end of the head 10 to engage the helical groove 52 (or 54) of the scroll member 28 (or 30) as shown in FIG. 9 such that all of the honing assemblies 44 are maintained at the same radially extended positions to engage a work surface in all rotational positions of the scroll members. The radially outwardly facing surfaces of the teeth 48 and 50 preferrably have an arcuate shape for better engagement with the surfaces of the helical grooves 52 and 54 of the scroll members 28 and 30, which arcuate shape can be the same for each pin, as desired. What is different between each pair of pins 34 an 36 from the other pairs will therefore be the length of the pin portion from the teeth 48 and 50 to where the pins are connected to the respective honing assemblies.

It is important that all of the honing assemblies 44 about the body 12 simultaneously engage the work surface in all positions of adjustment. With such a construction, the total force applied to the stone assemblies 44 will be relatively equally distributed, and if each of the pins 34 and 36 may have more than one tooth 48 and 50 that engages more than one lap of the respective helical groove 52 or 54. Because of this they are capable of Producing substantial outward honing pressure on the stone members 46 against the work. This is important to the present construction because the present construction is designed to be used with various types of abrasives including with superabrasives in order to reduce the time required to hone a surface to some desired diameter. Also by being able to exert relatively higher pressures on the harder honing members makes it possible to hone more rapidly than in the past when using vitrified abrasives, and with the present construction, it is also possible to hone more accurately and under more controlled conditions since little or no wear occurs on the honing members. This also means that more workpieces can be honed in a given time, to greater accuracy and before any adjustment and/or parts replacement is required. When using superabrasives stone dressing is also eliminated.

Referring again to FIG. 5, the locations of the various radial bores such as bores 20, 22, 24 and 26 are clearly shown. Similar sets of bores can be located on all or any number of sides of the body 12 where honing assemblies are provided such as adjacent to side faces 120–129. The counterbore 16 in the end of the body 12 is also shown provided with the similar circumferentially spaced communicating radial passages 20. The axially extending bore 14 through the body 12 which accomodates the shaft 28 is also shown.

The subject honing device is designed to be rotated in a bore in a workpiece. The means for rotating the mandrel are included in the honing machine as aforesaid and are not part of the present invention. The rotating means may have one or more universal joints to enable the mandrel or head to better accommodate itself alignmentwise to the bore being honed and without binding. The feed adapter 106 is also connected to means in the honing machine which rotate it relative to the mandrel in the desired direction to maintain all of the honing assemblies 44 and especially the abrasive portions 46 thereof in engagement, under load, with the bore being honed. As the honing progresses, pressure is maintained on the honing stones in the radial outward direction to produce the desired honing pressure. This is accomplished through the feed adapter 106 and means in the honing machine. If universal connections are provided for the main head drive, similar but smaller universals will also be provided for the feed up drive means.

Once a desired honing diameter has been achieved during a honing operation, the rotation of the feed adapter 106 for radially extending the honing assemblies 44 will be stopped to remove honing pressure or produce spark out or run out as desired, or the feed adapter 106 can be rotated in the opposite direction relative to the honing head 12 to cause the scroll feed members 28 and 30 to rotate in the opposite direction relative to the head 12 to cause all of the honing assemblies 44 to be simultaneously radially retracted. Spark out is a term used to describe the final phase or portion of a honing operation when the pressure is relieved, without expanding the diameter. Spark out usually relieves stresses and contributes to roundness. It is especially important to the present construction to maintain all of the assemblies engaged with the work surface during honing and by means which are able to exert considerable force on the honing assemblies to increase the honing and stock removal rate. It is also important during a typical honing operation to stroke or reciprocate the honing head back and forth so that all portions of the workpiece surface are honed and are honed to the same dimension. In this regard, it is important that the means and forces that produce the reciprocating motion not be transmitted to the means for expanding the honing assemblies 44 radially. If it were otherwise, looseness might develop between the parts and this can cause inaccuracies. This is overcome in the present construction by using pins which move radially or nearly radially only and are independent of the forces that produce the reciprocating or stroking motion. The means that stroke the mandrel are not part of this invention.

Figure 10:
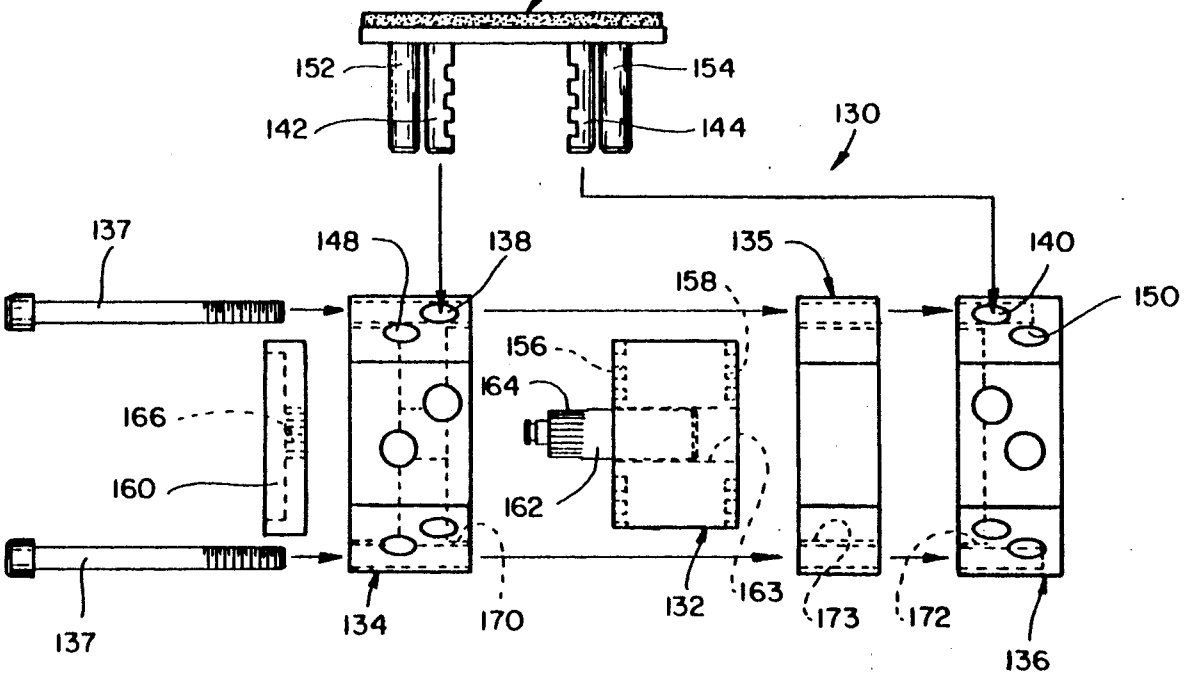
FIG. 10 is an exploded view of a modified form of the subject honing mandrel.

FIG. 10 shows another embodiment 130 of the subject honing mandrel assembly. In the construction 130 body portion 132, which can have any desired length, is shown positioned between spaced end members 134 and 136 which together with a spacer member 135 are bolted together by bolts or like means 137. The end members 134 and 136 rather than the body 132 have radial bores 138 and 140 respectively for accommodating the drive pins 142 and 144 on the stone assemblies 146, and other radial bores 148 and 150 for accommodating in this case outboard guide pins 152 and 154 respectively. In the construction 130 the central body member 132 has scroll shape grooves 156 and 158 formed in the opposite end faces thereof for cooperation with the teeth (or pin means) on the drive pins 142 and 144. The end plate 134 receives a drive plate 160 which couples the assembly 130 to a planetary gear arrangement which may be similar to the assembly 82 described above.

The main difference between the construction 130 shown in FIG. 10 and the assembly 10 described above is that the drive pins 142 and 144 in the construction 130 have their teeth or other scroll engaging means facing one another in opposed relationship for engaging the opposed helical grooves 156 and 158 formed in the opposite ends of the body 132 rather than engaging grooves formed in separate scroll plates located adjacent opposite ends of a central body member. In the construction 130 shown in FIG. 10, a shaft 162 is fixedly attached to the body 132 in bore 163, and is splined at 164 for engaging a similar splined opening 166 in the member 160. The construction 130 also has the central tube like body member 135 which encloses the body 132 and extends between the members 134 and 136 and is connected thereto by the same longitudinally extending threaded members 137. The members 134 and 136 also have facing counterbores 170 and 172 respectively, which counterbores together with the passage 173 through the member 135 accommodate the scroll member 132 therewithin when the mandrel 130 is assembled.

In the construction 130 the pins 142 and 144 are shown having opposed sets of teeth for engaging adjacent laps of the scroll grooves 156 and 158. In order to install the plurality of assemblies 146 on the mandrel, the pins 142 and 144 on each assembly, one at a time, are introduced into the open outer ends of the respective bores 138 and 140, and when so introduced one assembly at a time the member 132 is rotated relative to the connected member 134, 135 and 136 to draw the assembles 146 inwardly to the desired depths. This means that the assemblies 146 can be introduced and removed without disassembling the structure 130.

Figure 11:
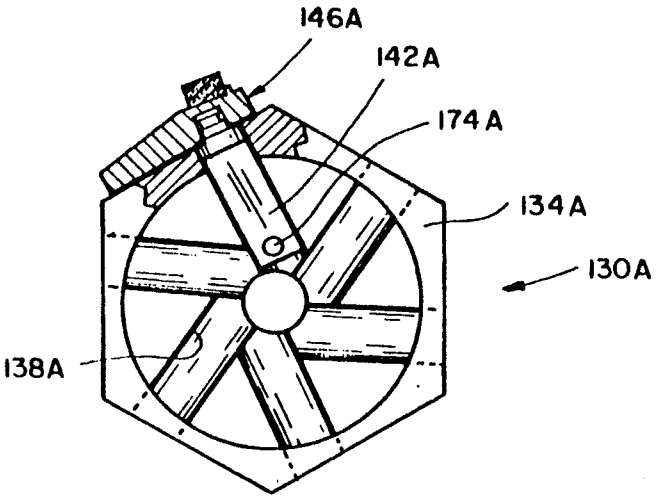
FIG. 11 is a right side view of the scroll members 134 in FIG. 10 showing another form of pin for engaging the scroll.
Figure 13:
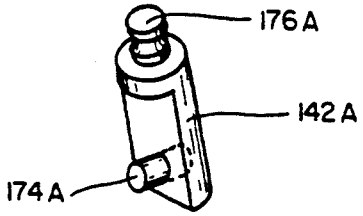
FIG. 13 is a perspective view of one of the pins shown in FIG. 12.
Figure 12:
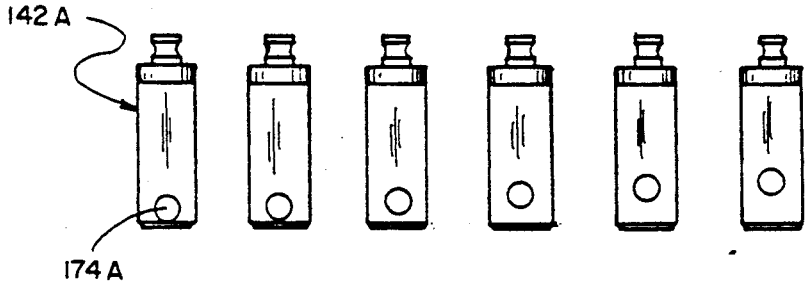
FIG. 12 shows a set of six pins for engaging a scroll feed member at one end of the mandrel of FIG. 10.

FIG. 11 shows an alternate embodiment 130A of the construction 130 wherein the body members 134A (and 136A) which are similar in both constructions have provision for pins 142A which are constructed to be cylindrical over most of their lengths and to have sidewardly extending pegs 174A which engage a lap of the scroll feed grooves 156A (or 158A). The pins 142A, of which there is shown provision for six, are also shown extending at an acute angle relative to the true radius of the device. This has an advantage of better concentrating of the honing pressure and makes for a somewhat more efficient construction. This is also applicable to the construction 10 described above. FIG. 12 shows a set of six such pins for use in the construction 130A wherein all of the pins have their peg portions 174A at different locations therealong depending upon where they engage the scroll groove 156A so as to have all honing assemblies 146A engage the work. FIG. 13 is a perspective view of one of the pins 142A. The pin 142A has means 176A on its outer end for attaching it to a honing assembly such as a honing assembly 146A. The pins 142A can be installed one at a time by starting them in the respective bores 138A and 140A as aforesaid.

Figure 14:
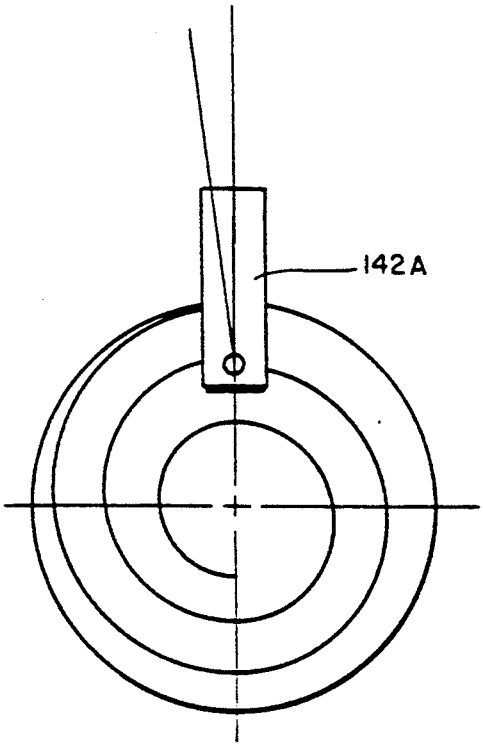
FIG. 14 is an illustrative side-elevational view of one of the scroll feed members shown in FIG. 10 showing the orientation of one of the pin members for movement radially relative to the axis of the device.
Figure 15:
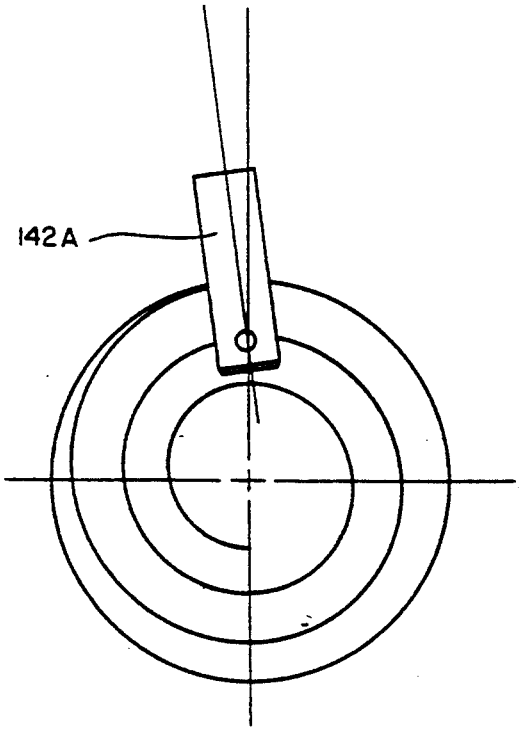
FIG. 15 is a view similar to FIG. 14 but showing the pin member oriented to move at an angle relative to the radius of the device.

FIGS. 14 and 15 are views illustrative of several orientations of the pins 142A, the pin 142A shown in FIG. 14 being oriented for movement in a radial direction while the pin 142A in FIG. 15 is oriented to move at an angle of approximately 7° to the true radius as in the construction shown in FIG. 11. The construction of FIG. 15 produces a better force vector and is more efficient for most honing applications.

The subject mandrel can be used to hone through bores as well as closed ended bores because the mandrel is not required to have any of its parts extend beyond the end of the stones. This can be an important consideration in some applications.

Thus there has been shown and described a novel honing head construction which fulfills all of the objects and advantages sought therefor. It will be apparent to those skilled in the art, however, that many changes, modifications, variations and other uses and applications for the subject device are possible. All such changes, modifications, variations and other uses and applications which do not depart from the spirit and scope of the invention are deemed to be covered by the invention which is limited only by the claims which follow.

What is claimed is:

1. A honing head comprising:

a body rotatable about an axis of rotation having a plurality of side surfaces therearound, an axial bore extending therethrough and spaced opposed end surfaces each having an associated counterbore therein, a shaft extending through the axial body bore and a pair of spaced plate members attached thereto and extending outwardly therefrom in the respective counterbores adjacent to the respective opposed body end surfaces, each of said plate members having a helical ridge formed by a plurality of laps forming a helical groove therebetween, the helical ridges on the plate members being positioned in opposing relation, pairs of axially aligned substantially radially extending bores in the body extending from selected ones of the body side surfaces adjacent the end surfaces, each of said bores having an open side portion formed by the counterbore adjacent to the respective body end surface, a pin member positioned in each of the radial bores of each pair, each of said pin members having an axial sidewardly extending portion formed by at least one tooth positioned extending axially therefrom through the open side portion of the respective radial bore for engagement with at least one lap of the helical ridge formed on the adjacent plate member, a plurality of elongated honing assemblies positioned along selected ones of the body side surfaces substantially between the end surfaces thereof, each of said honing assemblies being connected to the pin members in one pair of the radial body bores, and means operatively connecting the shaft and the plate members attached thereto to the body to enable relative rotational movement therebetween including during a honing operation to radially reposition the honing assemblies on the body.

2. A honing head comprising:

an elongated body rotatable about a rotational axis having an axial bore therethrough, spaced opposed end surfaces and a plurality of side surfaces extending between the end surfaces, each end surface having a counterbore therein, a shaft extending through the body bore and a pair of spaced plate members attached thereto and extending outwardly therefrom in the counterbore adjacent to the respective opposed body end surfaces, each of said plate members having a helical ridge defining a helical groove therebetween formed thereon, the ridges on the spaced plate members being positioned in opposed relation, the helical ridge on one plate member being a mirror image of the helical ridge on the other plate member, a plurality of substantially radially extending bores extending into the body toward the rotational axis from selected side surfaces adjacent to the opposed end surfaces, each bore having an open side portion formed by the counterbore on the side of the bore adjacent to the respective body end surface, the bores being arranged in axially aligned pairs, a pin member positioned in each radial bore, each of said pin members having at least one axially extending tooth positioned extending through the open side portion of the respective radial bore for extending into the groove formed by the helical ridge on the adjacent plate member, .

a honing assembly extending axially along the body adjacent to the selected ones of the side surfaces, each of said honing assemblies extending substantially between the body end surfaces, each of said honing assemblies being connected adjacent the ends thereof to the pin members in a pair of aligned bores, and means operatively connecting the shaft to the body whereby rotation of the shaft and the plate members attached thereto relative to the body produces radial movement of the honing assemblies.

3. A honing head comprising:

an elongated body rotatable about a rotational axis having spaced opposite end surfaces, an axial bore extending therethrough between the end surfaces and a plurality of circumferentially located side surfaces extending between the end surfaces around the body, a counterbore formed in each end surfaces, spaced plate members positioned respectively in the counterbores adjacent to the respective opposite body end surfaces, each plate member having a helical groove formed on one side thereof adjacent to the respective body end surface, the helical groove formed in one plate member being a mirror image of the helical groove formed in the other plate member and arranged in opposed relation, a shaft extending through the axially extending body bore and attached to the plate members adjacent opposite ends thereof, a plurality of pairs of axially aligned substantially radially extending bores in the body extending from selected ones of the side surfaces adjacent to the respective end surfaces, each bore being open along a portion of the side thereof by the counterbore adjacent to the helical groove on the adjacent plate member, a pin member positioned in each radial bore, each pin member having at least one tooth formed on the side thereof in position to extend axially into a lap of the helical groove on the adjacent plate member, means operatively connected to the shaft for rotating the shaft and the plate members attached thereto in convert relative to the body to change the radial positions of the pin members in the respective radial bores, and a work engaging assembly connected to the pin members positioned in each pair of aligned bores.

4. The honing head of claim 3 including a planetary gear arrangement having one portion operatively connected to the plate member at one end of the body, a second portion operatively connected to the body, and drive means operatively connected to the planetary gear assembly to rotate the shaft and the attached plate members relative to the body.

5. A honing mandrel having an elongated body portion with a bore extending axially therethough, the body portion having spaced end faces and an outer surface extending therebetween, each end face having an associated counterbore therein, at least two pairs of aligned substantially radially extending bores in the body, each of said radially extending bores extending into one of said counterbores and having an open side portion formed by the respective counterbore, the bores of each pair being positioned in alignment axially adjacent to the respective end faces, a separate end plate positioned in the counterbore of each end face, a shaft extending through the body bore connecting the end plates together, each end plate having a helical groove on the side thereof facing the respective body end face, each helical groove extending from an outer end adjacent to the periphery thereof to an inner end adjacent to the shaft, the helical groove on one of the end plates being a mirror image of the helical groove on the other end plate, a pin member positioned in each radial extending bore of each pair, each pin having at least one sidewardly extending tooth for engagement with the helical groove on the end plate adjacent thereto whereby rotation of the end plates relative to the body portion causes the pin members in all of said radial bores to move radially in the same direction and at substantially the same rate, a honing assembly connected to the pin members of each pair for radial movement therewith, and means operatively connected to the shaft and to the body portion for moving the end plates relative to the body portion.

6. The honing mandrel of claim 5 wherein the means for moving the end plates relative to the body portion includes a planetary gear assembly.

7. A honing head comprising:

an elongated body rotatable about a rotational axis having a plurality of side surfaces located circumferentially therearound and extending between opposed end faces, the end faces each having a counterbore formed therein, a bore through the body extending between the opposed end faces, a shaft extending through the body bore having a pair of spaced plate members attached thereto, one of the plate members extending outwardly therefrom in the counterbore associated with each of the respective body end faces, each of said plate members having a helical ridge formed by a plurality of laps, the ridges and laps on the spaced plate members being positioned to be in opposing relation.

pairs of axially aligned radially extending bores in the body, the bores of each pair being adjacent to respective body end faces and extending into the counterbore thereat, each bore of each pair having an open side portion formed by the counterbore adjacent to the respective end face, a pin member positioned in each of the radial bores of each pair, each of said pin members having an axially extending portion formed by radially spaced teeth positioned extending through the open side portion of the respective radial bore for engagement with a plurality of adjacent laps of the helical ridge on the adjacent plate member, a plurality of elongated honing assemblies positioned extending along selected ones of the body side surfaces substantially between the end faces, each of said honing assemblies being connected to the pin members in one pair of aligned radial bores adjacent the ends thereof, and means operatively connected to the shaft and to the body to enable rotating the shaft and the plate members attached thereto relative to the body to radially reposition the honing assemblies on the body.

8. A honing head comprising:

an elongated body rotatable about a rotational axis having an axially extending bore therethrough and spaced opposed end surfaces, each end face having a counterbore therein, a shaft extending through the body bore and a pair of spaced plate members attached thereto, one of the plate members extending outwardly therefrom in the counterbore adjacent to the respective opposed body end surfaces, each of said plate members having a helical ridge formed thereon adjacent to the respective body end surface, the helical ridges on the plate members being positioned to be in opposed relation.

a plurality of pairs of axially aligned substantially radially extending bores in the body, the bores of each pair being adjacent the respective end surafces and each bore extending into the respective counterbore to have a side portion that is open, a pin member positioned in each radial bore, each of said pin members having an axial extending portion positioned extending through the open side portion of the respective radial bore for engagement with at least one lap of the helical ridge on the adjacent plate member, a plurality of circumferentially spaced elongated honing assemblies positioned extending axially along the body substantially between the end surfaces thereof, each of said honing assemblies being connected adjacent the ends thereof to the pin members in an aligned pair of radially extending bores, and means operatively connected to the shaft and to the body to rotate the shaft and the plate members attached thereto relative to the body to radially reposition the pin member and the honing assemblies attached thereto.

9. A honing head comprising:

an elongated body rotatable about a rotational axis having spaced opposite ends and an axial bore extending therethrough and therebetween, a respective counterbore formed in each of the opposite ends of the body, a pair of spaced plate members positioned respectively in the counterbores adjacent to the respective opposite ends of the body, each plate member having a helical groove formed on the side thereof adjacent to the respective counterbore, the helical groove on one plate member being a mirror image of the helical groove in the other plate member, a shaft member extending through the body bore and attached to the plate members adjacent opposite ends thereof, at least two sets of substantially radially extending bores in the body, the bores in each set being axially aligned in the body and each bore being open along a portion thereof where it extends into the respective counterbore adjacent to the respective opposite end of the body and to the helical groove in the adjacent plate member, a pin member positioned in each radially extending bore, each pin member having axially extending teeth formed on the side thereof in position to engage adjacent laps of the helical groove on the adjacent plate member, means operatively connected to the plate members and to the body for rotating the plate members in concert relative to the body to change the radial positions of the pin members in the respective radial bores, and work engaging means connected to spaced pin members in each set of axially aligned bores adjacent to opposite ends of the body for radial movement during rotation of the plate members relative to the body.

10. The honing head of claim 9 including a planetary gear assembly having a first member connected to the plate member at one end of the body, and a second member operatively connected to drive means to rotate the plate members relative to the body to change the radial positions of the pin members relative to the body bores in which they are positioned.

11. A honing mandrel having an elongated body portion with a bore extending axially therethrough, the body portion having spaced end faces and an outer surface extending therebetween, at least three pairs of substantially radially extending bores in the body, the bores of each pair being positioned in alignment axially adjacent to the respective end faces, an end plate positioned adjacent each end face, a shaft extending through the body bore connecting the end Plates together, each end plate having a helical groove on the side thereof facing the respective body end face, each helical groove extending from an outer end adjacent to the outer surface thereof to an inner end adjacent to the shaft, the helical groove on one of the end plates being a mirror image of the helical groove on the other end plate, a pin member positioned in each radially extending bore of each pair, each pin having at least one sidewardly extending tooth for engagement with the helical groove on the end plate adjacent thereto whereby rotation of the end plates relative to the body portion causes all of the pin members to move radially in the same direction and at substantially the same rate, and a honing assembly connected to the pins of each pair for radial movement therewith.

12. The honing mandrel of claim 11 wherein the means for moving the end plates relative to the body portion includes a planetary gear assembly operatively connected to the shaft and to the body.

13. A honing mandrel having a body portion rotatable about a rotational axis with a bore extending axially therethrough, the body portion having spaced end faces and a side surface extending therebetween, a helical groove formed in each body end face and extending substantially from the axial bore to the body side surface, a shaft member extending through the body bore, a plate member adjacent each end face, each of said plate members having a similar number of substantially radial extending bores extending inwardly generally toward the axis and being open along a portion of a side thereof facing the respective body end face, the bores being arranged in axially aligned pairs around the respective plate members, a pin member positioned in each of said bores, each pin member having at least one axially extending portion engagable with the helical groove in the adjacent body end face, a plurality of circumferentially spaced axially extending work engaging assemblies positioned adjacent to the outer surface of the body portion and of the end plates, each of said work engaging assemblies being connected to a respective pair of axially aligned pin members, and means operatively connected to the plate members and to the body portion capable of rotating the plate members relative to the body portion to produce radial movements of the pin members and of the work engaging assemblies attached thereto.

14. The honing mandrel of claim 13 wherein the means capable of rotating the plate members relative to the body portion include a planetary gear assembly operatively connected therebetween.

15. The honing mandrel of claim 13 wherein each pin member has a plurality of teeth for engaging adjacent laps of the helical groove in the respective body end face.

16. The honing head of claim 1 including a second pair of spaced axially aligned bores in the body associated with each honing assembly and arranged so that a plane through the axes of the second pair of aligned bores is parallel to a second plane through the axes of the radially extending bores that have the pin member attached to the same honing assembly, a follower pin positioned in each bore of the second pairs of axially aligned bores, each follower pin having an end connected to the honing assembly connected to the pin members in the associated pairs of radial bores for movement in concert therewith during radially movements of the respective honing assembly.

* * * * *

UNITED STATES PATENT AND TRADEMARK OFFICE

CERTIFICATE OF CORRECTION

PATENT NO. : 5,243,792

DATED : September 14, 1993

INVENTOR(S) : Frank E. Vanderwal, Jr.

It is certified that error appears in the above-indentified patent and that said Letters Patent is hereby corrected as shown below:

Column 1, line 10, "Particularly" should be --particularly--.

Column 6, line 27, "Producing" should be --producing--.

Column 12, line 15, "surafces" should be --surfaces--.

Column 13, line 23, "Plates" should be --plates--.

Signed and Sealed this

Fifth Day of April, 1994

Bruce Lehman

*Attest:*

BRUCE LEHMAN

*Attesting Officer*

*Commissioner of Patents and Trademarks*